US010782640B2

(12) United States Patent
Akashi et al.

(10) Patent No.: US 10,782,640 B2
(45) Date of Patent: Sep. 22, 2020

(54) IMAGE FORMING DEVICE AND TONER PATCH FORMING METHOD

(71) Applicant: Konica Minolta, Inc., Tokyo (JP)

(72) Inventors: Hironori Akashi, Okazaki (JP); Soh Hirota, Toyokawa (JP); Shigeki Naiki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/562,873

(22) Filed: Sep. 6, 2019

(65) Prior Publication Data

US 2020/0081384 A1 Mar. 12, 2020

(30) Foreign Application Priority Data

Sep. 10, 2018 (JP) ..... 2018-168490

(51) Int. Cl.

| | |
|---|---|
| ***G03G 15/00*** | (2006.01) |
| ***G03G 21/00*** | (2006.01) |
| ***G03G 15/16*** | (2006.01) |
| *G03G 15/08* | (2006.01) |

(52) U.S. Cl.

CPC ..... *G03G 15/5054* (2013.01); *G03G 15/161* (2013.01); *G03G 21/0011* (2013.01); *G03G 15/0849* (2013.01)

(58) Field of Classification Search

CPC ..... G03G 15/5054; G03G 15/5058; G03G 15/161; G03G 21/0011

USPC ..... 399/49, 72, 350

See application file for complete search history.

(56) References Cited

U.S. PATENT DOCUMENTS 8,010,002 B2 * 8/2011 Nishikawa et al. ..... G03G 15/0194 399/49

2013/0034365 A1 2/2013 Nakade

FOREIGN PATENT DOCUMENTS

JP 2011022483 A 2/2011
JP 2013033137 A 2/2013

* cited by examiner

*Primary Examiner* — William J Royer
(74) *Attorney, Agent, or Firm* — Cantor Colburn LLP

(57) ABSTRACT

An image forming device that forms a toner image on a surface of a photoreceptor, transfers the toner image to a recording material and outputs a printed recording material, includes: an intermediate transfer body that primarily transfers the toner image on the photoreceptor and secondarily transfers the toner image to the recording material; a cleaner that removes a toner left on the surface of the photoreceptor; a patch forming unit that forms a toner patch between two adjacent toner images when multiple toner images are continuously formed on the surface of the photoreceptor; a concentration detector that detects concentration of the toner patch primarily transferred to the intermediate transfer body from the photoreceptor; and a patch adjuster that adjusts toner amount used for forming the toner patch based on a result detected by the concentration detector.

13 Claims, 15 Drawing Sheets

IMAGE FORMING DEVICE AND TONER PATCH FORMING METHOD

CROSS REFERENCE TO RELATED APPLICATION

The present application claims priority under 35 U.S.C. § 119 to Japanese Application No. 2018-168490 filed Sep. 10, 2018, the entire content of which is incorporated herein by reference.

BACKGROUND

Technological Field

The present invention relates to an image forming device that forms a toner image on a surface of a photoreceptor and transfers the toner image to a recording material to produce a printed output and a toner patch forming method applied in the image forming device.

Description of the Related Art

Image forming devices that form a toner image on a photoreceptor and transfer the formed toner image to a recording material to produce a printed output includes a cleaner blade for removing a toner left on a surface of the photoreceptor. This type of image forming device may produce friction between the photoreceptor and the cleaner blade. The larger friction causes chipping and/or turning up of the cleaner blade. The toner left on the surface of the photoreceptor cannot be removed satisfactory and this may cause image defects.

In order to control occurrence of the image defects as described above, an image forming device that forms an image patch (a toner patch) between a carried paper and a paper carried next, and supplies a predetermined amount of toner to the cleaner blade. This known technique is introduced for example in Japanese Patent Application Laid-Open No. JP 2013-33137A. According to the known technique, the conventional image forming device adjusts the amount of toner of the image patch in accordance with a printing rate of an image formed on the paper. Once the toner is supplied to the cleaner blade as described above, the friction produced between the photoreceptor and the cleaner blade can be reduced. Thus, this may control occurrence of the chipping and/or the turning up of the cleaner blade.

Recently, the image forming devices have been successful in realizing improved primary transfer rate for primarily transferring a toner image formed on the photoreceptor to an intermediate transfer body, which is almost 100%. Even when the image patch is formed on the surface of the photoreceptor between the papers when multiple numbers of papers are carried continuously, all of the toner forming the image patch is not supplied to the cleaner blade, and a part of the image patch is transferred to the intermediate transfer body. Under this circumstance, the toner of the image patch cannot be supplied sufficiently to the cleaner blade. This does not reduce the friction produced between the photoreceptor and the cleaner blade.

In order to prevent the part of the image patch transferred to the intermediate transfer body, it is considered to separate the intermediate transfer body from the surface of the photoreceptor which prevents the toner of the image patch being transferred to the intermediate transfer body when the image patch is formed between the papers, for example. In such a case, however, the intermediate transfer body once separated from the photoreceptor between the papers is required to be returned to a state that is in contact with the photoreceptor again. In order to return the intermediate transfer body back to the state, more than a predetermined period of a time difference should be taken between the papers. This requires wide intervals for carriage of papers, resulting in reduced throughput.

In order to control reduction of throughput, it is required to enable the intermediate transfer body to be in contact with the surface of the photoreceptor continuously even between the papers. In this case, it is considered to increase the toner amount for forming the image patch between the papers, for instance, as a way of maintaining the cleaner blade in a good condition. The increase in the toner amount of the image patch, however, also increases the toner amount primarily transferred to the intermediate transfer body. The toner transferred to the intermediate transfer body between the papers are not transferred to the paper. The toner transferred to the intermediate transfer body is adhered to a secondary transfer roller and soils rear sides of the following papers. There is a new problem that the toner amount primarily transferred to the intermediate transfer body is increased and a stain caused by the toner obviously appears on the rear side of the paper if the reduction of throughput is controlled.

SUMMARY

The present invention is intended to solve the above problems. Thus, the present invention is intended to provide an image forming device and a toner patch forming method that maintains a cleaner that removes a toner left on a surface of a photoreceptor in a good condition without causing reduction of throughput, and controls stains with the toner appear on a rear side of a paper.

First, the present invention is directed to an image forming device that forms a toner image on a surface of a photoreceptor, transfers the toner image to a recording material and outputs a printed recording material.

To achieve at least one of the abovementioned objects, according to an aspect of the present invention, the image forming device reflecting one aspect of the present invention comprises: an intermediate transfer body that primarily transfers the toner image on the photoreceptor and secondarily transfers the toner image to the recording material; a cleaner that removes a toner left on the surface of the photoreceptor; a patch forming unit that forms a toner patch between two adjacent toner images when multiple toner images are continuously formed on the surface of the photoreceptor; a concentration detector that detects concentration of the toner patch primarily transferred to the intermediate transfer body from the photoreceptor; and a patch adjuster that adjusts toner amount used for forming the toner patch based on a result detected by the concentration detector.

Second, the present invention is directed to a toner patch forming method that forms a toner patch between two adjacent toner images when multiple toner images are continuously formed on the surface of the photoreceptor. The toner patch forming method is applied at an image forming device that forms the toner image on the surface of the photoreceptor, secondarily transfers to a recording material after primary transfer of the toner image to an intermediate transfer body and outputs a printed recording material.

To achieve at least one of the abovementioned objects, according to an aspect of the present invention, the toner patch forming method reflecting one aspect of the present invention comprises: forming the toner patch on the surface of the photoreceptor; detecting a concentration of the toner patch primarily transferred to the intermediate transfer body from the photoreceptor; and adjusting a toner amount used for forming the next toner patch based on a detected result.

BRIEF DESCRIPTION OF THE DRAWING

The advantages and features provided by one or more embodiments of the invention will become more fully understood from the detailed description given herein below and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Preferred Embodiment

Figure 1:
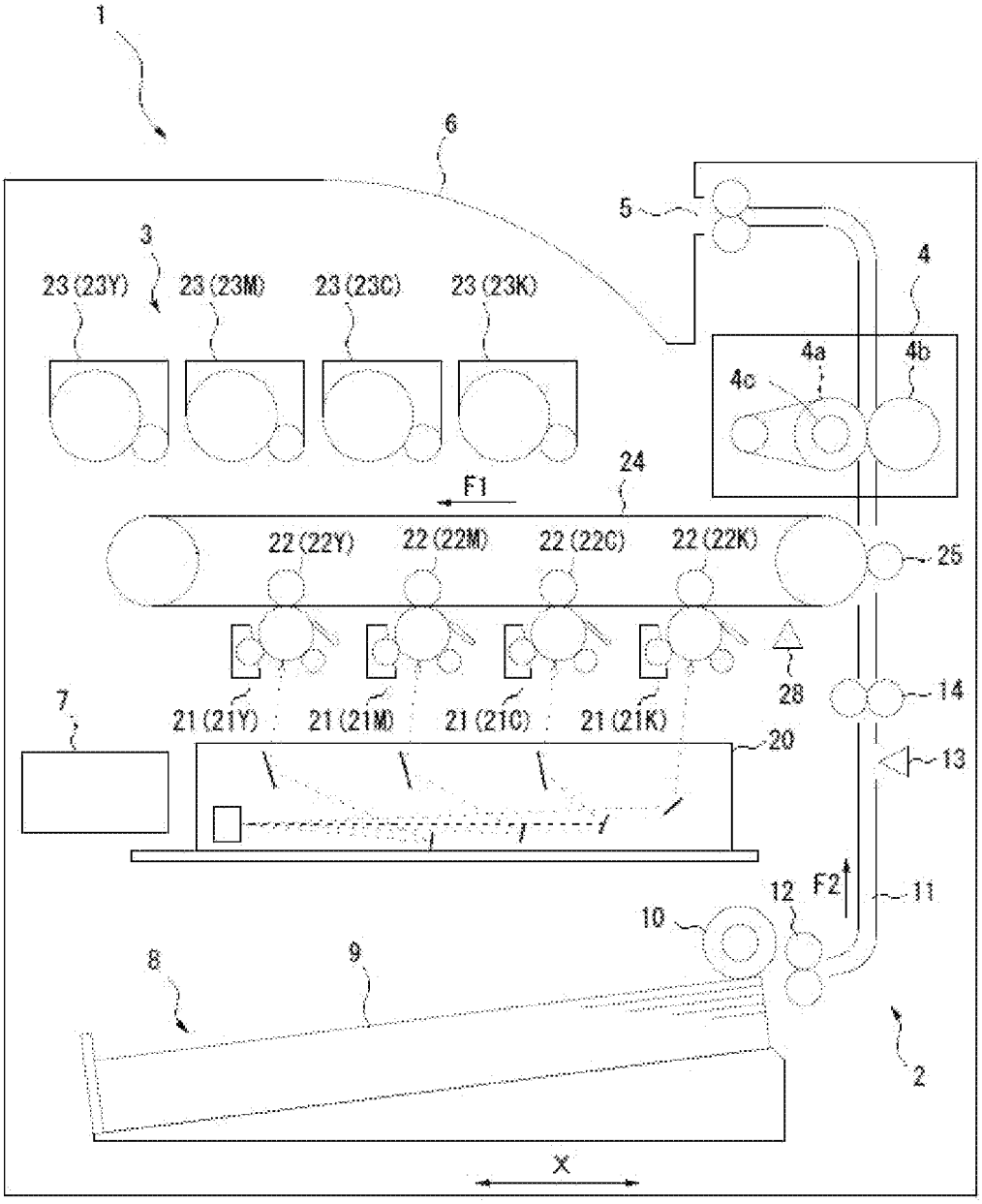
FIG. 1 illustrates an exemplary conceptual configuration of an image forming device.

FIG. 1 illustrates an exemplary conceptual configuration of an image forming device 1 in which the first preferred embodiment of the present invention may be practiced. The image forming device 1 of FIG. 1 is a printer capable of forming color images in a tandem system. The image forming device 1 includes a paper feeding unit 2, an image forming unit 3 and a fixing unit 4 inside a device body. The image forming device 1 forms a color image or a black and white image on a sheet type recording material 9 such as a print paper, and delivers the recording material 9 on a paper delivery tray 6 from a paper delivery port 5 provided in an upper part of the device body. The image forming device 1 includes a controller 7 inside the device body. The controller 7 controls operations of each part such as the paper feeding unit 2, the image forming unit 3 and the fixing unit 4.

The paper feeding unit 2 includes a paper feeding cassette 8, a pick up roller 10, a carrying path 11, a separation roller 12, a leading end detecting sensor 13, a resist roller 14 and a secondary transfer roller 25.

The paper feeding cassette 8 is a container in which a bundle of the sheet type recording materials 9 such as the print papers are stored. The paper feeding cassette 8 can be slid in an X direction in FIG. 1, for instance. The paper feeding cassette 8 is opened by pulling out from a lower part of the device body of the image forming device 1, or closed by pushing into the lower part of the device body. When the recording materials 9 stored in the paper feeding cassette 8 get into an empty condition, for example, a user pulls out and opens the paper feeding cassette 8 from the lower part of the device body so that he or she may supply the recording materials 9. The recording materials 9 storable in the paper feeding cassette 8 are of great variety. The recording materials 9 include thin papers, thick papers, plain papers, recycled papers, coated papers and OHP films, for instance.

The carrying path 11 is a path to carry the recording material 9 in an arrow F2 direction when the image forming device 1 forms an image on the recording material 9. The recording material 9 is carried along the carrying path 11 illustrated in FIG. 1 in the arrow F2 direction so that the image such as a toner image is transferred to a surface of the recording material 9. The image is fixed to the recording material 9 by the fixing unit 4, and the recording material 9 is delivered from the delivery port 5. The carrying path 11 of FIG. 1 shows a carrying path for forming an image only on a surface of the recording material 9. However, this is given not for limitation. The carrying path 11 may further include a recording material inversion path for forming an image on a back of the recording material 9.

The pick-up roller 10 takes the recording material 9 from an upper part of the bundle of the recording materials 9 stored in the paper feeding cassette 8, and carries to the carrying path 11. The pick-up roller 10 is in contact with a single sheet of the recording material 9 which is placed on a top of the bundle of the recording materials 9, and feeds the single recording material 9 to the downstream. When the single recording material 9 which is placed on the top is fed, the second recording material 9 which follows the recording material 9 on the top may be fed toward the downstream together with the recording material 9 on the top. The separation roller 12 controls that the recording material 9 after the second sheet which is fed together with the recording material 9 on the top not to be led to the downstream of the carrying path 11. The separation roller 12 only leads the recording material 9 on the top to the downstream. In the downstream side of the separation roller 12, the recording material 9 is carried one after another along the carrying path 11.

The leading end detecting sensor 13 is a sensor that detects a leading end of the recording material 9 carried on the carrying path 11. The resist roller 14 holds the leading end of the recording material 9 detected by the leading end detecting sensor 13, and feeds the recording material 9 to the secondary transfer roller 25 at a timing synchronized with the image forming operation by the image forming unit 3. The toner image primarily transferred to an intermediate transfer belt 24 is secondarily transferred on the surface of the recording material 9 fed by the resist roller 14 when the recording material 9 passes through the secondary transfer roller 25. The paper feeding unit 2 leads the recording material 9 to which the toner image is transferred to the fixing unit 4.

The image forming unit 3 forms toner images of four colors, Y (yellow), M (magenta), C (cyan) and K (black), and transfers the toner images of the four colors at the same time to the recording material 9 passing through the position of the secondary transfer roller 25. The image forming unit 3 includes an exposure unit 20, image forming units 21 (21Y, 21M, 21C and 21K), primary transfer rollers 22 (22Y, 22M, 22C and 22K), the intermediate transfer belt 24 and toner bottles 23 (23Y, 23M, 23C and 23K) of the respective colors. The image forming units 21 (21Y, 21M, 21C and 21K) are provided for the toners of respective colors. The primary transfer rollers 22 (22Y, 22M, 22C and 22K) are provided corresponding to the respective image forming units 21. The intermediate transfer belt 24 is an intermediate transfer body.

Four image forming units 21Y, 21M, 21C and 21K, for example, are provided in a lower position of the intermediate transfer belt 24. Each of the toner bottles 23Y, 23M, 23C and 23K supplies the toner of each color to the corresponding image forming unit 21Y, 21M, 21C or 21K.

The exposure unit 20 exposes a photoreceptor (an image carrier) provided with each image forming unit 21Y, 21M, 21C and 21K, and forms an electrostatic latent image on a surface of the photoreceptor of each image forming unit 21Y, 21M, 21C and 21K. Each image forming unit 21Y, 21M, 21C and 21K develops the electrostatic latent image with the toner so that the toner image is formed on the surface of the photoreceptor. Each image forming unit 21Y, 21M, 21C and 21K then superposes the toner image of each color one after another on the intermediate transfer belt 24 which is circulated and moved in an arrow direction F1 to apply primary transfer. When the intermediate transfer belt 24 passes through the position of the image forming unit 21K which is at the downstream end, a color image which is superposing the toner images of four colors is formed on the surface of the intermediate transfer belt 24. When an image is black and white, a black and white image of only K (black) is formed on the surface of the intermediate transfer belt 24. The toner image formed on the intermediate transfer belt 24 is in contact with the recording material 9 carried by the paper feeding unit 2 and secondarily transferred on the surface of the recording material 9 when passing through a position faces to the secondary transfer roller 25.

The fixing unit 4 includes a heating roller 4*a* and a pressure roller 4*b*. The fixing unit 4 enables the recording material 9 to which the toner image is transferred to go through between the heating roller 4*a* and the pressure roller 4*b*, and applies a heating operation and a pressure operation to the recording material 9. The fixing unit 4 then fixes the toner image to the recording material 9. The heating roller 4*a* includes a heater 4*c*. Temperature of the heating roller 4*a* rises due to heating of the heater 4*c*. The toner image is fixed to the recording material 9 by the fixing unit 4. The recording material 9 with the fixed toner image is then delivered on the paper delivery tray 6 from the delivery port 5.

A toner concentration detecting sensor 28 is provided to detect a concentration of a toner image transferred to the intermediate transfer belt 24 between the image forming unit 21K at the downstream end and the secondary transfer roller 25. The toner concentration detecting sensor 28 detects the concentration of the toner image based on one or more than one part in a width direction of the intermediate transfer belt 24 which is circularly moved in the arrow F1 direction. After detecting the concentration of the toner image, the toner concentration detecting sensor 28 outputs a concentration value to the controller 7. When continuously forming the toner images, the controller 7 finely adjusts the toner concentration based on the concentration detected by the toner concentration detecting sensor 28.

Figure 2:
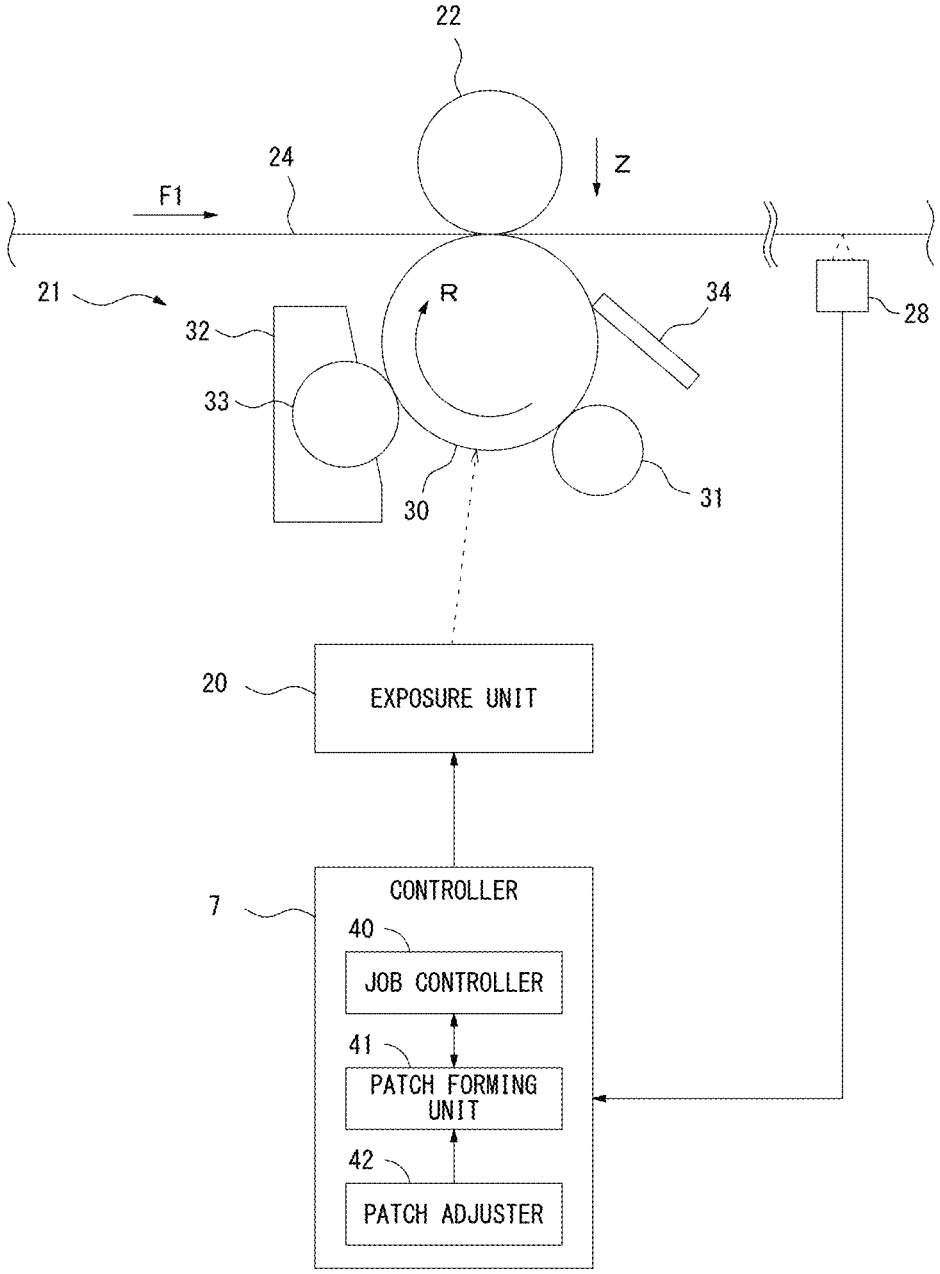
FIG. 2 illustrates an exemplary structure of an image forming unit in detail.

FIG. 2 illustrates an exemplary structure of the image forming unit 21 in detail. FIG. 2 illustrates only the single image forming unit 21 as an example. Each of the structures of the image forming units 21Y, 21M, 21C and 21K of the respective colors is the same as that in FIG. 2. The image forming unit 21 includes a cylindrical photoreceptor 30. An electrifying roller 31, a developing unit 32 and a cleaner 34 are provided around the photoreceptor 30.

The photoreceptor 30 has almost the same length as a length in the width direction of the intermediate transfer belt 24. The photoreceptor 30 rotates in an arrow R direction as illustrated in in FIG. 2. The electrifying roller 31 electrifies the surface of the photoreceptor 30 that rotates in the R direction to be electrified at a predetermined potential. The exposure unit 20 irradiates the surface of the photoreceptor 30 electrified at the predetermined potential with a light such as a LED light or a laser light in accordance with the image data so that the electrostatic latent image is formed on the surface of the photoreceptor 30. The developing unit 32 develops the electrostatic latent image formed on the photoreceptor 30. The developing unit 32 includes a developing roller 33 to which a developing bias voltage is applied. The developing unit 32 supplies a developer to the developing roller 33 with stirring a carrier and a toner as the developer. The developing roller 33 provides a potential gap between the potential of the electrostatic latent image and the developing bias voltage with the developer to form the toner image. As a result, the toner image corresponding to the image data is formed on the surface of the photoreceptor 30. The toner image formed on the surface of the photoreceptor 30 moves toward a position facing the primary transfer roller 22 when the photoreceptor 30 rotates in the R direction.

The intermediate transfer belt 24 may be pressed against the photoreceptor 30. Under this condition, the primary transfer roller 22 applies a primary transfer bias so that the toner image on the photoreceptor 30 is transferred to the intermediate transfer belt 24. The primary transfer roller 22 is enabled to advance and retreat in a Z direction. The primary transfer roller 22 enables the intermediate transfer belt 24 to be in contact with the photoreceptor 30 and/or separated from the photoreceptor 30. When enabling the intermediate transfer belt 24 to be in contact with the photoreceptor 30, it may adjust a pressing force applied in the Z direction.

The cleaner 34 removes the toner left on the surface of the photoreceptor 30. The cleaner 34 is constructed as a cleaner blade formed from an elastic material such as rubber, for instance. An end of the blade of the cleaner 34 is arranged to be in contact with the surface of the photoreceptor 30, and removes the toner left on the surface of the photoreceptor 30 that rotates in the R direction.

The controller 7 controls operations of each aforementioned unit. The controller 7 is connected to a network such as a LAN (Local Area Network) which is not illustrated in any figures. After receiving a print job over the network, the controller 7 drives the paper feeding unit 2, the image forming unit 3 and the fixing unit 4 to control forming the image on the recording material 9. The controller 7 includes a CPU and a memory which are not illustrated in figures. The CPU executes a predetermined program so that the controller 7 serves as a job controller 40, a patch forming unit 41 and a patch adjuster 42. The program executed by the CPU is stored in advance in a computer readable recording medium such as a memory.

The job controller 40 controls processing of the print job. To be more specific, after receiving the print job, the job controller 40 drives each of the paper feeding unit 2, the image forming unit 3 and the fixing unit 4 to start printing in response to the print job. The job controller 40 drives the photoreceptor 30, the electrifying roller 31, the exposure unit 20, the developing unit 32, the intermediate transfer belt 24 and the primary transfer roller 22 to form the electrostatic latent image and the toner image on the photoreceptor 30 based on the image data included in the print job and transfer the toner image to the intermediate transfer belt 24. When the image data included in the print job is a color image, the job controller 40 brings four image forming units 21Y, 21M, 21C and 21K to transfer the color image to the intermediate transfer belt 24. The color image to be transferred is formed by superposing each color's toner image. When the image data included in the print job is a black and white image, the job controller 40 only brings the image forming unit 21K to transfer the black and white image constituting just the K color toner image to the intermediate transfer belt 24.

The job controller 40 carries the recording material 9 to the secondary transfer roller 25 that synchronizes the timing that the toner image transferred to the intermediate transfer belt 24 reaches the secondary transfer roller 25, and applies a predetermined secondary transfer bias voltage to the secondary transfer roller 25 so that the toner image is secondarily transferred to the recording material 9. The job controller 40 then drives the fixing unit 4 to apply the fixing processing to the recording material 9 to which the toner image is transferred. After the toner image is fixed to the recording material 9, the recording material 9 is delivered on the paper delivery tray 6.

The print job may continuously carry the multiple recording materials 9 and form the image, for instance. In this case, the job controller 40 drives the primary transfer roller 22 at a start of carrying the first recording material 9 and enables the intermediate transfer belt 24 to be in contact with the photoreceptor 30. The job controller 40 keeps the state that the intermediate transfer belt 24 and the photoreceptor 30 being in contact with each other until the image is formed on the last recording material 9. To be more specific, the job controller 40 keeps the state that the intermediate transfer belt 24 being in contact with the surface of the photoreceptor 30 from start to completion of processing of the print job. As a result, intervals of carrying the multiple recording materials 9 may be reduced and reduction of throughput at processing of the print job may be controlled.

When the image is continuously formed on the multiple recording materials 9, a friction between the cleaner 34 and the photoreceptor 30 may exceed a predetermined range. The friction exceeding the predetermined range causes chipping and/or turning up of the cleaner blade, resulting in decrease in cleaning performance. In order to avoid the decrease in cleaning performance, the controller 7 brings the patch forming unit 41 and the patch adjuster 42 in operation to form a toner patch between the toner images to transfer to the recording material 9 when the print job is to form the image on the multiple recording materials 9. More specifically, the controller 7 forms the toner patch in a space (gap) between one of the toner images and the one after. The toner images are formed one after the other on the surface of the photoreceptor 30 based on the image data included in the print job. The toner patch is not the toner image formed on the photoreceptor 30 to be transferred to the recording material 9. The toner patch is to supply the toner to the cleaner 34 exceeding the primary transfer position by the primary transfer roller 22 to reduce the friction produced between the cleaner 34 and the photoreceptor 30.

As described above, the patch forming unit 41 and the patch adjuster 42 become operative when the print job to continuously carry the multiple recording materials 9 and form the image is processed. The patch forming unit 41 and the patch adjuster 42 form the toner patch on the surface of the photoreceptor 30 between the previous recording material 9 and the following recording material 9. The patch forming unit 41 drives the exposure unit 20 and the image forming unit 21 to control forming the toner patch between longitudinally adjacent two toner images. The patch forming unit 41, for example, controls the exposure unit 20 to form the electrostatic latent image of the toner patch on the photoreceptor 30 between the toner image to transfer to the previous recording material 9 and the toner image to transfer to the following recording material 9. The patch forming unit 41 enables the developing unit 32 to develop the electrostatic latent image so that the toner patch is formed on the surface of the photoreceptor 30.

Figure 3A:
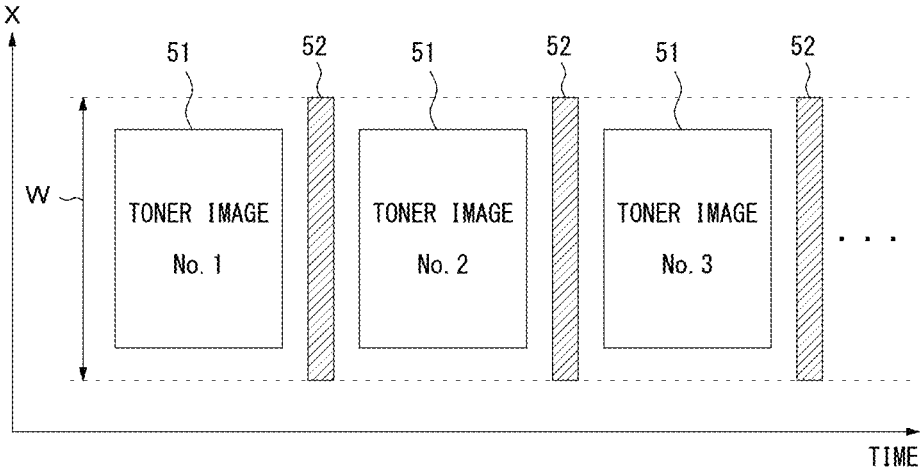
FIG. 3A and FIG. 3B illustrate an example of a toner patch formed on a surface of a photoreceptor.
Figure 3B:
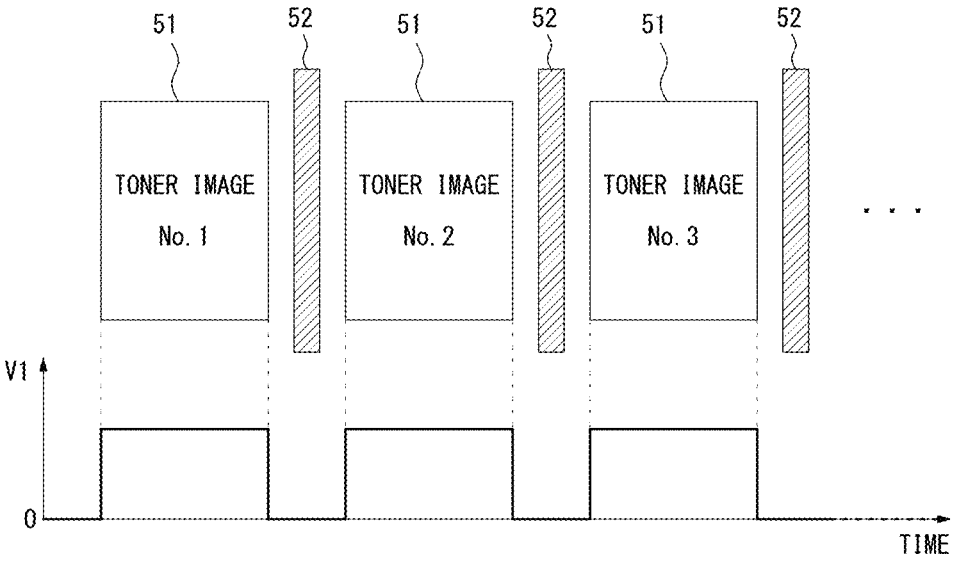

FIG. 3A and FIG. 3B illustrate an example of a toner patch 52 formed on the surface of the photoreceptor 30. As illustrated in FIG. 3A, once the job controller 40 starts processing the print job, a toner image 51 corresponding to the image data included in the print job is formed one after another on the surface of the photoreceptor 30. A size in main scanning direction X of the toner image 51 corresponds to the size of the recording material 9, for instance.

The patch forming unit 41 forms the toner patch 52 between the two adjacent toner images 51 and 51. The toner patch 52 is formed in every gap between the adjacent toner images 51, for example, as illustrated in FIG. 3A. A size W in main scanning direction X of the toner patch 52 corresponds to a whole area in which the toner image can be formed on the surface of the photoreceptor 30. More specifically, the toner patch needs to supply along the overall area that the cleaner 34 and the photoreceptor 30 are in contact with each other. The toner patch, therefore, is formed to cover the overall area in main scanning direction X.

As described above, it is preferable for the toner patch 52 formed on the surface of the photoreceptor 30 not to be primarily transferred to the intermediate transfer belt 24 as much as possible. When a portion including the formed toner patch 52 reaches a position facing the secondary transfer roller 25, the patch forming unit 41 turns off a primary transfer bias voltage V1 as illustrated in FIG. 3B. Instead of turning off the primary transfer bias voltage V1, the patch forming unit 41 may apply a voltage having opposite polarities from the primary transfer bias voltage V1 to the primary transfer roller 22. As a result, the transfer of the toner patch 52 to the intermediate transfer belt 24 may be controlled. In this case, the patch forming unit 41 serves as a transfer controller that controls not to have the toner patch 52 transferred to the intermediate transfer belt 24.

According to the first preferred embodiment, a primary transfer efficiency to the intermediate transfer belt 24 from the photoreceptor 30 is high. Even when the primary transfer bias voltage V1 is turned off or the voltage having opposite polarities from the primary transfer bias voltage V1 is applied, at least a part of the toner patch is transferred to the intermediate transfer belt 24.

In order to maintain the cleaning performance of the cleaner 34 by controlling the friction produced between the cleaner 34 and the photoreceptor 30, the toner more than a predetermined amount should be supplied to the cleaner 34 by the toner patch 52. The toner amount of the toner patch 52 left on the surface of the photoreceptor 30 after passing through the primary transfer roller 22 needs not to be remained above a lower limit set in advance.

The more toner amount for forming the toner patch 52, the more toner amount primarily transferred to the intermediate transfer belt 24. The more toner amount of the toner patch 52 transferred to the intermediate transfer belt 24 may cause apparent stains with toner when the toner is stuck on the back of the following recording material 9. In order to prevent the stains with toner from becoming conspicuous, it is necessary to suppress the toner amount of the toner patch 52 transferred to the intermediate transfer belt 24 to be less than the predetermined amount.

The patch adjuster 42 detects a concentration of the toner patch 52 transferred to the intermediate transfer belt 24 using the toner concentration detecting sensor 28, and adjusts the toner amount for the patch forming unit 41 to form the toner patch 52 based on a detected result.

Figure 4A:
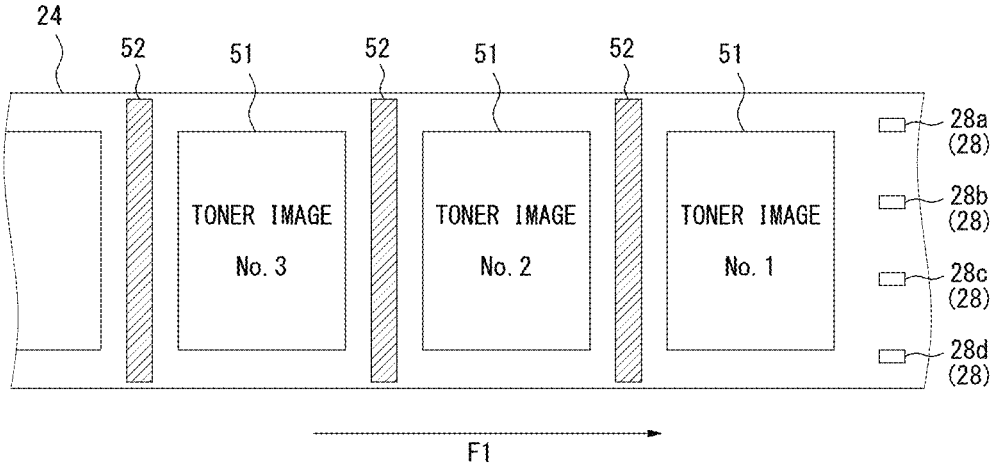
FIG. 4A and FIG. 4B illustrate an example of the toner patch transferred to an intermediate transfer belt.
Figure 4B:
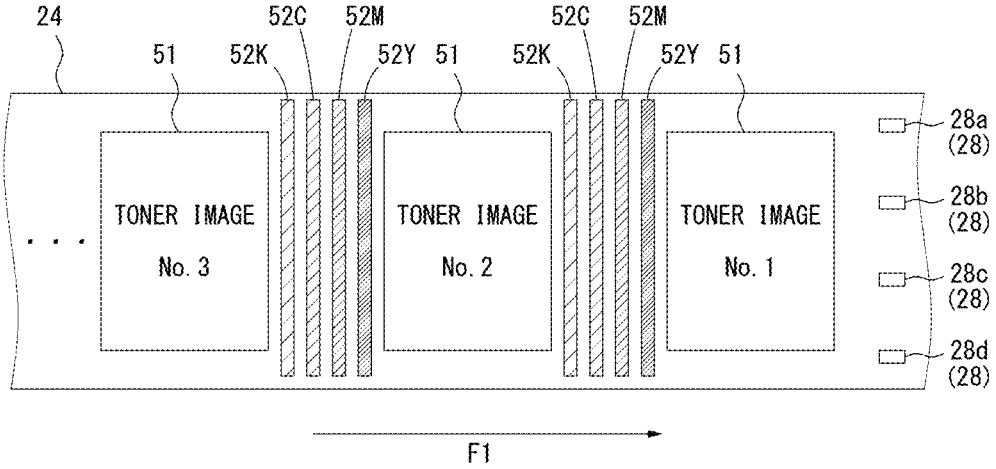

FIG. 4A and FIG. 4B illustrate an example of the toner patch 52 transferred to the intermediate transfer belt 24. As illustrated in FIG. 4A, in the downstream of the intermediate transfer belt 24, the toner concentration detecting sensor 28 is arranged. FIG. 4A illustrates an example where four toner concentration detecting sensors 28*a* to 28*d* are arranged with roughly equal intervals along the width direction of the intermediate transfer belt 24. Each of the four toner concentration detecting sensors 28*a* to 28*d* measures the toner concentration of the toner image 51 and/or the toner patch 52, and outputs a measured value to the controller 7.

FIG. 4B illustrates an example of forming the toner patch when the color image is formed. The color image may be formed in response to processing the print job. In this case, all of the image forming units 21Y, 21M, 21C and 21K are used. As the photoreceptor 30 is used in every image forming unit 21Y, 21M, 21C and 21K, the toner patch 52 is formed in every image forming unit 21Y, 21M, 21C and 21K. The position of the toner patch 52 formed in each image forming unit 21Y, 21M, 21C and 21K may be shifted in a vertical scanning direction (arrow F1 direction) so that each color Y, M, C and K's toner patch 52Y, 52M, 52C and 52K may be separately formed between two toner images 51 and 51 on the intermediate transfer belt 24 as illustrated in FIG. 4B. Each color's toner patch 52Y, 52M, 52C and 52K is separately formed so that the toner concentration of each color may be detected separately by the respective toner concentration detecting sensors 28*a*, 28*b*, 28*c* and 28*d*.

The patch adjuster 42, based on the concentration of the toner patch 52 on the intermediate transfer belt 24 measured as described above, adjusts the toner amount of the toner patch 52 formed by the patch forming unit 41. Thus, the patch forming unit 41 is enabled to set a certain toner amount for forming the toner patch 52 on the surface of the photoreceptor 30. The certain toner amount is that the toner amount that prevents the stains with toner stuck on the back of the following recording material 9 becoming conspicuous and decrease in the cleaning performance of the cleaner 34. As a result, the throughput in printing is not reduced and the cleaner 34 that removes the toner left on the surface of the photoreceptor 30 is maintained in good condition. Moreover, this can prevent the stains with toner stuck on the back of the recording material 9.

When processing of the print job is started and the first toner patch 52 is formed on the surface of the photoreceptor 30, the patch forming unit 41 sets the toner amount corresponding to a default value set in advance or the toner amount determined during processing of the previous print job and forms the toner patch 52. When the first toner patch 52 is primarily transferred to the intermediate transfer belt 24, the patch adjuster 42 obtains the concentration value of the toner patch 52 detected by the toner concentration detecting sensor 28, and determines the concentration value of the toner patch 52 to be formed for the next time and after when the patch is formed based on the concentration value of the toner patch 52 on the intermediate transfer belt 24. The patch forming unit 41 forms the toner patch 52 based on the concentration value determined by the patch adjuster 42 when forming the toner patch 52 for the next job and after.

There are several ways to adjust the toner amount when the patch forming unit 41 forms the toner patch 52. A change in an exposure amount of the photoreceptor 30 by the exposure unit 20 leads a change in the toner concentration of the toner patch 52. Thus, the toner amount used for the toner patch 52 is enabled to be changed. If the potential at which the electrifying roller 31 electrifies the photoreceptor 30 is changed, for example, the toner concentration may be changed in response to the change in the potential. A change in the developing bias voltage applied to the developing roller 33 may enable the change in the toner concentration. If the width in the vertical scanning direction (corresponding to the exposure time) of the toner patch 52 is changed, the toner amount may be changed. The patch forming unit 41 combines one or more of the aforementioned ways to adjust the toner amount of the toner patch 52. The patch forming unit 41 may use only one of the aforementioned ways to adjust the toner amount.

The patch adjuster 42 is enabled to store in advance a primary transfer rate (transfer rate to the intermediate transfer belt 24 from the photoreceptor 30) when the primary transfer bias voltage V1 is turned off or the voltage having opposite polarities from the primary transfer bias voltage V1 is applied. The patch adjuster 42 is enabled to calculate the toner concentration of the toner patch 52 left on the surface of the photoreceptor 30 after passing through the primary transfer position based on the concentration value of the toner patch 52 detected by the toner concentration detecting sensor 28. The patch adjuster 42, therefore, is enabled to determine the exposure amount which enables the toner concentration of the toner patch 52 left on the surface of the photoreceptor 30 to be equal to or above the predetermined lower limit and the toner concentration of the toner patch 52 detected by the toner concentration detecting sensor 28 to be below a predetermined upper limit.

Figure 5:
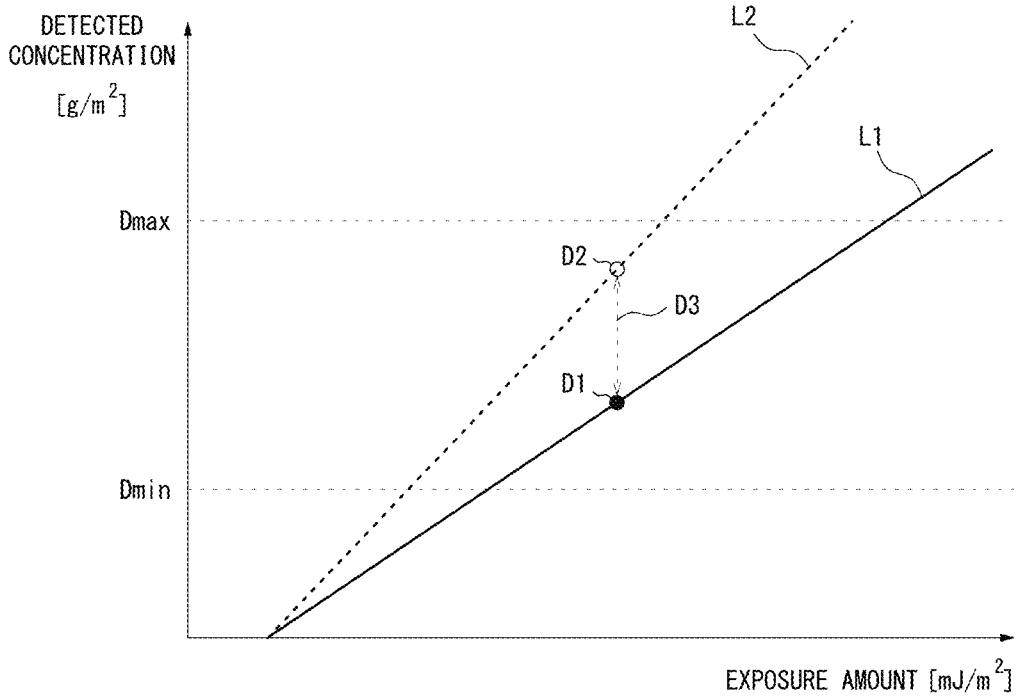
FIG. 5 illustrates a relation between a toner concentration and an exposure amount of the toner patch.

FIG. 5 illustrates a relation between the toner concentration and the exposure amount of the toner patch 52. A line L1 of FIG. 5 shows the toner concentration of the toner patch 52 transferred to the intermediate transfer belt 24 and that is detected by the toner concentration detecting sensor 28. A broken line L2 shows the toner concentration at a time when the toner patch 52 is formed on the surface of the photoreceptor 30 by the patch forming unit 41. After obtaining a concentration value D1 of the toner patch 52 measured by the toner concentration detecting sensor 28, the patch adjuster 42 performs an arithmetic calculation based on the primary transfer rate with the obtained concentration value D1 and obtains a concentration value D2 at a time when the toner patch 52 is formed on the surface of the photoreceptor 30 by the patch forming unit 41. More specifically, the concentration value D2 is a concentration value of the toner patch 52 prior to the primary transfer to the intermediate transfer belt 24. The patch adjuster 42 calculates a difference D3 between the concentration value D2 of the toner patch 52 formed on the photoreceptor 30 and the concentration value D1 of the toner patch 52 primarily transferred to the intermediate transfer belt 24. The difference D3 corresponds to the concentration value of the toner left on the surface of the photoreceptor 30 after the primary transfer. The patch adjuster 42 is enabled to determine the exposure amount that enables the concentration value D2 to become equal to or above the predetermined lower limit and the concentration value D1 to become below the predetermined upper limit.

The patch adjuster 42, however, does not always have to perform the arithmetic calculation as described above. To be more specific, the relation between the toner concentration and the exposure amount may be linearly approximated. Also, the line L1 and the broken line L2 have correlation and degrees of inclinations of the lines are just different. A lower limit Dmin and an upper limit Dmax may be set for the concentration value D1 detected by the toner concentration detecting sensor 28, and the exposure amount that enables the concentration value D1 to be in a range of the lower limit Dmin to the upper limit Dmax may be determined. The lower limit value that is set to a value that enables the toner amount supplied to the cleaner 34 not to cause decrease in the cleaning performance as the lower limit Dmin. The upper limit value that is set to a value that does not make the stains with toner on the back of the recording material 9 become conspicuous as the upper limit Dmax. When the concentration value D1 detected by the toner concentration detecting sensor 28 is below the lower limit Dmin, the patch adjuster 42 is enabled to give an instruction to the patch forming unit 41 to increase the exposure amount by the exposure unit 20. When the concentration value D1 is equal to or above the upper limit Dmax, the patch adjuster 42 is enabled to give an instruction to the patch forming unit 41 to reduce the exposure amount by the exposure unit 20. For forming the next toner patch 52 on the surface of the photoreceptor 30, the patch forming unit 41 is enabled to expose the photoreceptor 30 based on the exposure amount instructed by the patch adjuster 42. The toner patch 52 thereby formed on the photoreceptor 30 has the toner amount that does not decrease the cleaning performance of the cleaner 34 and does not make the stains with toner on the back of the recording material 9 due to the toner primarily transferred to the intermediate transfer belt 24 become conspicuous.

Figure 6:
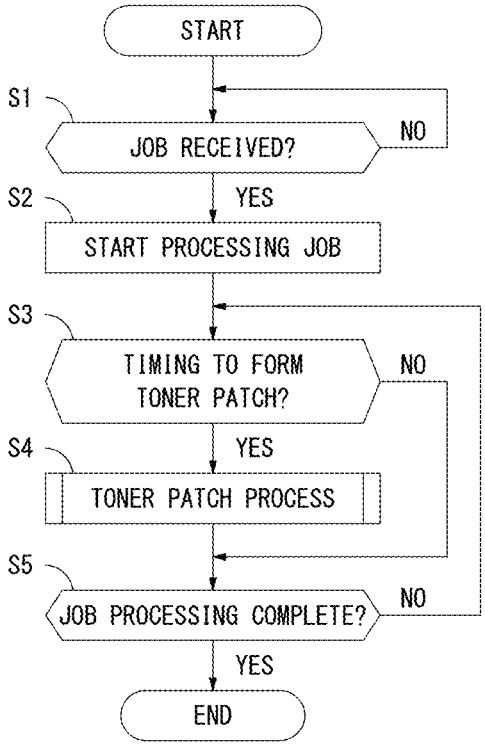
FIG. 6 illustrates a flow diagram explaining an exemplary procedure of a process performed by a controller.

A process sequence performed by the image forming device 1 is explained next. FIG. 6 illustrates a flow diagram explaining an exemplary procedure of a process performed by the controller 7. This process based on the flow diagram is performed when the CPU of the controller 7 executes the predetermined program. Upon start of the process, the controller 7 waits until receiving the print job (step S1). In response to receiving the print job (when a result of step S1 is YES), the controller 7 starts processing the received print job (step S2). As a result, the paper feeding of the recording material 9 is started at the image forming device 1 and the operation to enable the intermediate transfer belt 24 to be in contact with the photoreceptor 30 and transfer the toner image to the recording material 9 is started.

After starting processing the print job, the controller 7 determines if it is the time to form the toner patch 52 (step S3). The print job may be the job to form the image on multiple recording materials 9 and it may be the time that the exposure processing to form the toner image corresponding to the print job is complete and the time to form the toner patch 52. In such a case, the controller 7 determines YES as a result of step S3. When determining it is the time to form the toner patch 52 during the processing of the print job (when a result of step S3 is YES), the controller 7 performs a toner patch process (step S4). When determining it is not the time to form the toner patch 52 (when a result of step S3 is NO), the controller 7 skips without performing the process in step S4. The controller 7 then determines whether or not the processing of the print job is complete (step S5). If the processing of the print job is continued (when a result of step S5 is NO), the controller 7 returns to step S3 to repeat the above-described process. The toner patch process (step S4) is performed repeatedly every time it is determined that it is the time to form the toner patch 52 during the processing of the print job. Once the processing of the print job is complete (when a result of step S5 is YES), the process by the controller 7 is complete.

Figure 7:
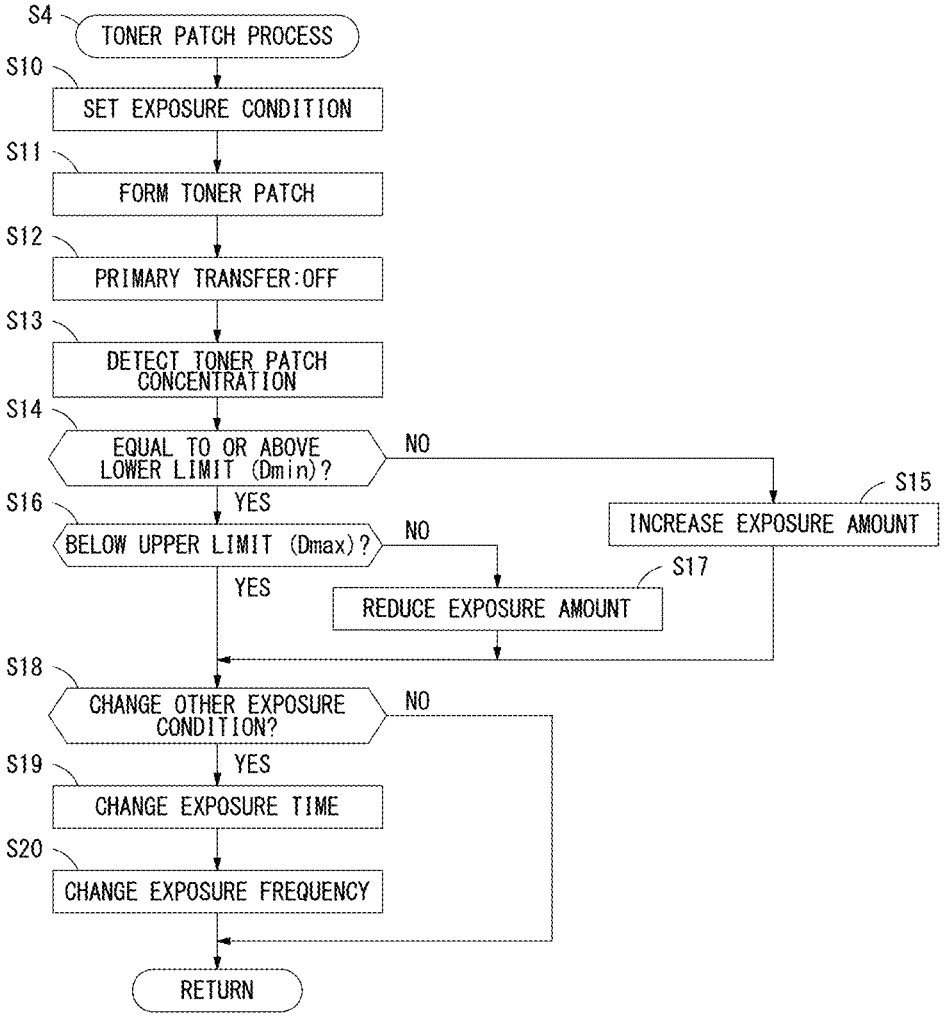
FIG. 7 illustrates a flow diagram explaining an exemplary procedure of a toner patch process in detail.

FIG. 7 illustrates a flow diagram explaining an exemplary procedure of the toner patch process (step S4) in detail. After starting the toner patch process (step S4), the controller 7 sets an exposure condition for forming the toner patch 52 (step S10). The exposure condition thereby set includes, for instance, the exposure amount, an exposure time and an exposure frequency. The exposure frequency is a frequency of forming the toner patch 52. A value of N when the single toner patch 52 is formed every time N (N is an integer more than 1) sheets of the toner image is formed is set as the exposure frequency. For forming the first toner patch 52 after starting processing of the print job, the controller 7 sets the exposure amount, the exposure time and the exposure frequency corresponding to the predetermined default value as the exposure condition. However, this is given not for limitation. The exposure condition determined during the processing of the previous print job may be set. When the exposure condition has already been determined during the processing of the current print job, the controller 7 sets the exposure condition already determined.

After setting the exposure condition, the controller 7 forms the toner patch 52 based on the exposure condition (step S11). To be more specific, the controller 7 applies the exposure condition set in step S10 and exposes the photoreceptor 30. The controller 7 then forms the electrostatic latent image of the toner patch 52 and develops the electrostatic latent image so that the toner patch 52 is formed on the surface of the photoreceptor 30. After forming the toner patch 52 on the surface of the photoreceptor 30, the controller 7 turns off the primary transfer bias voltage V1 just before the toner patch 52 reaches the primary transfer position (step S12). As a result, the toner transfer to the intermediate transfer belt 24 from the photoreceptor 30 can be controlled. However, at least a part of the toner patch 52 is still transferred to the intermediate transfer belt 24.

The controller 7 then obtains the concentration value D1 of the toner patch 52 detected by the toner concentration detecting sensor 28 (step S13), and determines if the concentration value D1 is equal to or above the predetermined lower limit Dmin (step S14). When the concentration value D1 is below the lower limit value Dmin (when a result of step S14 is NO), the controller 7 increases the exposure amount for forming the next toner patch 52 (step S15). As a result, the next toner patch 52 is formed with the toner amount that does not decrease the cleaning performance of the cleaner 34.

When the concentration value D1 is equal to or above the predetermined lower limit Dmin (when a result of step S14 is YES), the controller 7 determines if the concentration value D1 is below the predetermined upper limit Dmax (step S16). When the concentration value D1 is equal to or above the predetermined upper limit Dmax (when a result of step S16 is NO), the controller 7 reduces the exposure amount for forming the next toner patch 52 (step S17). As a result, the next toner patch 52 is formed with the toner amount that does not cause the stains with toner on the back of the recording material 9.

The controller 7 determines if it is necessary to change the other exposure conditions (step S18). The controller 7 determines if it is necessary to change the exposure time and/or exposure frequency for forming the toner patch 52. If the other exposure conditions should be changed (when a result of step S18 is YES), the controller 7 changes the exposure time for forming the next toner patch 52 (step S19). The width (size) in the vertical scanning direction of the toner patch 52 changes, and the toner amount used for the toner patch 52 can be adjusted. The controller 7 changes the exposure frequency for forming the toner patch 52 (step S20). The frequency of forming the toner patch 52 then can be adjusted during the processing of the print job. If no other exposure condition should be changed (when a result of step S18 is NO), the toner patch process (step S4) is complete.

As described above, in order to control the decrease in the cleaning performance of the cleaner 34, the image forming device 1 of the first preferred embodiment forms the toner patch 52 between the two toner images 51 and 51 that are formed one after another based on the print job when processing the print job for continuously forming the images on the multiple recording materials 9, and supplies the toner used for the toner patch 52 to the cleaner 34. The image forming device 1 keeps the intermediate transfer belt 24 in contact with the photoreceptor 30 even while forming the toner patch 52 on the photoreceptor 30, not resulting in reduction of throughput in printing. Furthermore, when forming the toner patch 52 on the photoreceptor 30 during the processing of the print job, the image forming device 1 detects the toner concentration of the toner patch 52 primarily transferred to the intermediate transfer belt 24 from the photoreceptor 30, and adjusts the toner amount for forming the toner patch 52 on and after next time based on the detected result. The image forming device 1 directly measures the toner concentration of the toner patch 52 transferred to the intermediate transfer belt 24, and adjusts the toner amount of the toner patch 52 formed on and after next time. As a result, the image forming device 1 controls not to have stains with toner on the back of the recording material 9 and to maintain the toner amount supplied to the cleaner 34 to be an appropriate condition.

A condition corresponding to the size of the recording material 9 may be set as the exposure condition for forming the toner patch 52 after starting processing of the print job. To be more specific, once the size of the recording material 9 changes, the size of the toner image 51 formed on the surface of the photoreceptor 30 changes. The size in the vertical scanning direction of the toner image 51 also changes, and this enables a running distance (rotation number) of the photoreceptor 30 required for transferring the single toner image to the intermediate transfer belt 24 to change depending on the size of the recording material 9. The toner image 51 based on the print job is transferred to the intermediate transfer belt 24 from the photoreceptor 30 at the primary transfer rate close to 100%. If the size in the vertical scanning direction of the toner image 51 gets larger, the more toner is not supplied to the cleaner 34 for a long time. If the size of the recording material 9 gets larger, the toner amount should be supplied to the cleaner 34 between the two toner images 51 and 51. In contrast, if the size of the recording material 9 is small, the less toner amount should be supplied to the cleaner 34 between the two toner images 51 and 51. As described above, the exposure condition for forming the toner patch 52 may be adjusted corresponding to the size of the recording material 9 and the toner amount of the toner patch 52 may be determined corresponding to the size of the recording material 9. An example is shown as a chart 1 below.

TABLE 1

| RECORDING MATERIAL | LENGTH IN VERTICAL SCANNING DIRECTION [mm] | REQUIRED TONER AMOUNT [mg/SHEET] | PATCH TONER AMOUNT [mg/TIME] | EXCESS AND DEFICIENCY [mg/SHEET] |
|---|---|---|---|---|
| A6S | 105 | 0.50 | 1.00 | +0.50 |
| A4L | 210 | 1.00 | 1.00 | 0.00 |
| A3S | 420 | 2.00 | 1.00 | −1.00 |

The chart 1, for example, shows that the recording material 9 of "A4L" has its length in the vertical scanning direction of 210 mm, and the toner amount required for the toner patch 52 formed between the two toner images 51 and 51 is 1 mg per sheet. On the other hand, when a certain condition is set as the exposure condition for forming the toner patch 52, the toner amount that can be supplied to the cleaner 34 with the single toner patch 52 is 1.00 mg per time. The toner amount that can be supplied is constant regardless of the size of the recording material 9.

The recording material 9 of "A6S" has its length in the vertical scanning direction of 105 mm, and the toner amount required for the toner patch 52 formed between the two toner images 51 and 51 is 0.50 mg per sheet. More specifically, on the basis of the recording material 9 of "A4L," the recording material 9 of "A6S" and the recording material 9 of "A4L" are compared. The recording material 9 of "A6S" has a half of the length in the vertical scanning direction compared to the recording material 9 of "A4L." This means the gap in which the toner patch 52 can be formed appears in the twice frequency. Thus, the toner amount required for the toner patch to be formed in the gap is 0.50 mg per sheet which is a half of the recording material 9 of "A4L." When the recording material 9 is "A6S," the patch adjuster 42 may reduce the exposure amount to a half of the exposure amount for "A4L." Alternatively, the patch adjuster 42 may set a half of the exposure time and a half of the width in the vertical scanning direction compared to the recording material 9 of "A4L." The patch adjuster 42 does not have to form the toner patch 52 every time the gap between the toner images 51 and 51 appears. The patch adjuster 42 may form the toner patch 52 once in two times the gaps appear.

The recording material 9 of "A3S" has its length in the vertical scanning direction of 420 mm, and the toner amount required for the toner patch 52 formed between the two toner images 51 and 51 is 2.00 mg per sheet. More specifically, in comparison with the recording material 9 of "A4L," the recording material 9 of "A3S" has twice the length in the vertical scanning direction compared to the recording material 9 of "A4L." The toner amount required for the toner patch 52 to be formed in the gap is 2.0 mg per sheet which is twice the toner amount required for the recording material 9 of "A4L." When the recording material 9 is "A3S," the patch adjuster 42 may double the exposure amount compared to the exposure amount for "A4L." Alternatively, the patch adjuster 42 may set a twice the exposure time and a twice the width in the vertical scanning direction compared to the recording material 9 of "A4L."

As described above, the patch adjuster 42 adjusts the toner amount for forming the toner patch 52 in accordance with the size of the recording material 9 so that it may supply the toner degree to which reduction in cleaning performance of the cleaner 34 is not caused during processing of the print job when the recording material 9 of whatever size is used. Even in this case, it is expected that the toner amount for forming the toner patch 52 on and after next time is adjusted based on the concentration value of the toner patch 52 detected by the toner concentration detecting sensor 28 during processing of the print job as described above.

As described above, the cleaner that removes the toner left on the surface of the photoreceptor is maintained in a good condition without reduction in throughput of the image forming device. Moreover, stains with toner on the back of the recording material such as a paper can be controlled.

Second Preferred Embodiment

The second preferred embodiment of the present invention is explained next. According to the second preferred embodiment, an example where the multiple toner patches 52 are formed between the two adjacent toner images 51 and 51 is explained. The structure of the image forming device 1 of the second preferred embodiment is the same as that explained in the first preferred embodiment.

Figure 8:
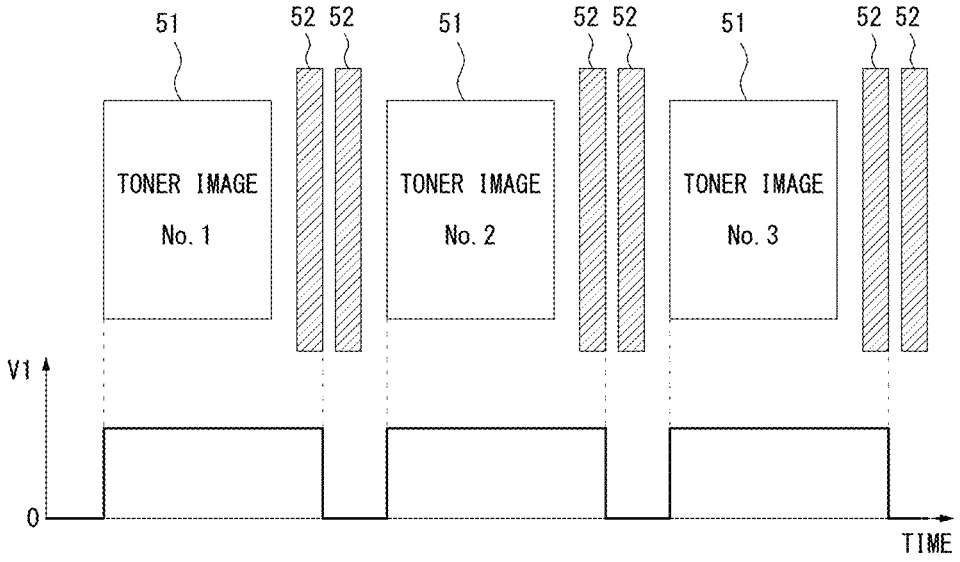
FIG. 8 illustrates another example of the toner patch formed on the surface of the photoreceptor.

FIG. 8 illustrates an example of the toner patch 52 formed on the surface of the photoreceptor 30 of the second preferred embodiment. As illustrated in FIG. 8, once the job controller 40 starts processing the print job, the toner image 51 corresponding to the image data included in the print job is formed one after the other on the surface of the photoreceptor 30.

The patch forming unit 41 forms the two toner patches 52 and 52 between the two adjacent toner images 51 and 51. In the example of FIG. 8, for example, the two toner patches 52 and 52 are formed every time the gap between the two adjacent toner images 51 and 51 appears. The toner concentration of the two toner patches 52 and 52 are the same.

When the two toner patches 52 and 52 pass through the primary transfer position, the patch forming unit 41 transfers one of the toner patches 52 to the intermediate transfer belt 24 as well as the toner image 51, and controls the transfer of another toner patch 52. To be more specific, the patch forming unit 41 keeps turning on the primary transfer bias voltage V1 applied to the primary transfer roller 22 when the first toner patch 52 formed after the previous toner image 51 passes through the primary transfer position, and turns off the primary transfer bias voltage V1 applied to the primary transfer roller 22 when the second toner patch 52 passes through the primary transfer position. The patch forming unit 41 may apply the voltage having opposite polarities from the primary transfer bias voltage V1 to the primary transfer roller 22 rather than turning off the primary transfer bias voltage V1. As a result, the first toner patch 52 is transferred to the intermediate transfer belt 24 at the primary transfer rate close to 100%. The second toner patch 52 is controlled not to be transferred to the intermediate transfer belt 24 so that the less toner amount is transferred to the intermediate transfer belt 24.

Figure 9:
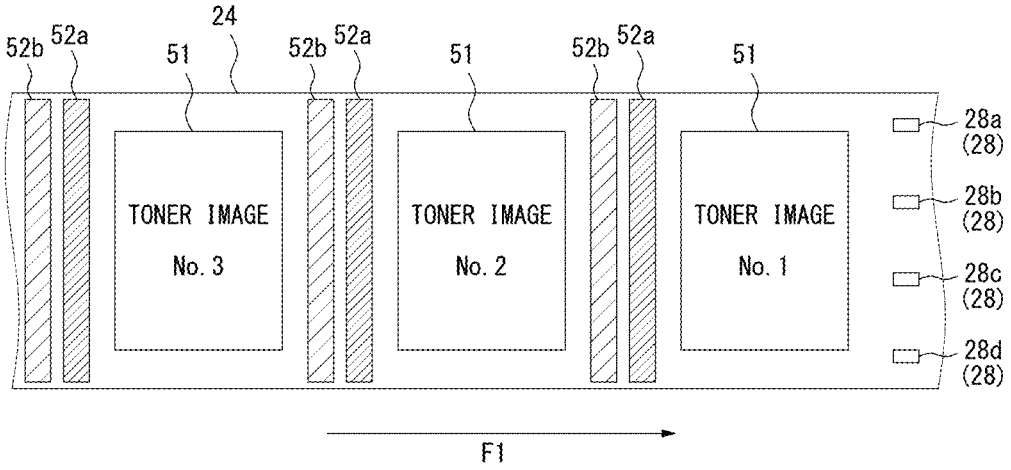
FIG. 9 illustrates another example of the toner patch transferred to the intermediate transfer belt.

FIG. 9 illustrates an example of the toner patch 52 transferred to the intermediate transfer belt 24 in which the second preferred embodiment may be practiced. Changes made in the primary transfer bias voltage V1 applied when each of the two toner patches 52 and 52 passes through the primary transfer position enables two types of toner patches 52*a* and 52*b* to be formed on the intermediate transfer belt 24. The two types of the toner patches include the toner patch 52*a* with higher toner concentration and the toner patch 52*b* with the lower toner concentration. The toner concentrations of the two types of the toner patches 52*a* and 52*b* are detected when passing through the position of the toner concentration detecting sensor 28. To be more specific, the toner concentration detected from the toner patch 52*a* with higher toner concentration corresponds to the concentration value D2 shown by the broken line L1 of FIG. 5. The toner concentration detected from the toner patch 52*b* with lower toner concentration corresponds to the concentration value D1 shown by the line L1 of FIG. 5. To be more specific, the image forming device 1 of the second preferred embodiment switches the primary transfer rate of the two toner patches 52 and 52 so that both of the concentration values D1 and D2 of FIG. 5 are measured, which is different from the first preferred embodiment. As described above, both of the concentration values D1 and D2 are measured so that a concentration value D3 of the toner of the toner patch 52*b* left on the surface of the photoreceptor 30 can be calculated accurately after passing through the primary transfer position.

Operations performed by the image forming device 1 of the second preferred embodiment is explained next. The main procedure by the controller 7 is the same as that illustrated in the flow diagram of FIG. 6 of the first preferred embodiment. The toner patch process (step S4) of the second preferred embodiment is different from that of the first preferred embodiment. The toner patch process (step S4) of the second preferred embodiment is explained below.

Figure 10:
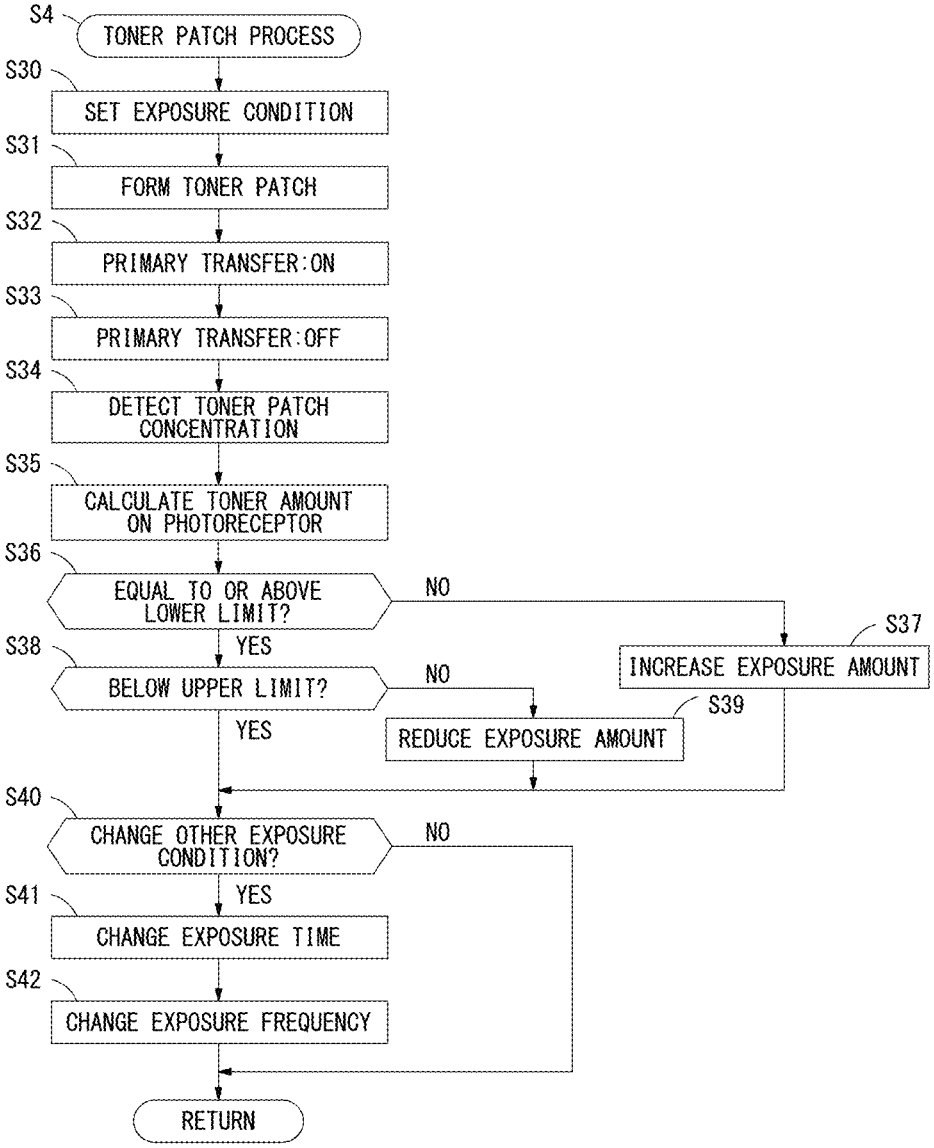
FIG. 10 illustrates a flow diagram explaining another exemplary procedure of the toner patch process in detail.

FIG. 10 illustrates a flow diagram explaining an exemplary procedure of the toner patch process (step S4) in which the second preferred embodiment may be practiced in detail. After starting the toner patch process (step S4), the controller 7 sets the exposure condition for forming the toner patch 52 (step S30). This process is the same as the process in step S7 of FIG. 7. After setting the exposure condition, the controller 7 forms the toner patch 52 based on the exposure condition (step S31). The controller 7 forms the two toner patches 52 and 52 which have the same toner concentrations between the two toner images 51 and 51. When the first toner patch 52 passes through the primary transfer position, the controller 7 keeps turning on the primary transfer voltage V1 (step S32). When the second toner patch 52 passes through the primary transfer position, the controller 7 turns off the primary transfer voltage V1 (step S33). As a result, the two types of toner patches 52*a* and 52*b* with the different toner concentrations can be formed on the intermediate transfer belt 24.

The controller 7 then obtains the concentration values D1 and D2 of the two types of toner patches 52*a* and 52*b* detected by the toner concentration detecting sensor 28 (step S34), and calculates the concentration value D3 of the toner patch 52*b* left on the surface of the photoreceptor 30 (step S35). The controller 7 determines if the concentration value D3 is equal to or below the predetermined lower limit (step S36). When the concentration value D3 is below the lower limit (when a result of step S36 is NO), the controller 7 increases the exposure amount for forming the next toner patch 52 (step S37). As a result, the next toner patch 52 is formed with the toner amount that does not reduce the cleaning performance of the cleaner 34.

When the concentration value D3 is equal to or above the predetermined lower limit (when a result of step S36 is YES), the controller 7 determines if the concentration value D2 of the toner patch 52*a* is below the predetermined upper limit (step S38). When the concentration value D2 is equal to or above the predetermined upper limit (when a result of step S38 is NO), the controller 7 reduces the exposure amount for forming the next toner patch 52 (step S39). As a result, the next toner patch 52 is formed with the toner amount that does not cause the stains with toner on the back of the recording material 9.

The controller 7 determines if it is necessary to change the other exposure conditions (step S40). If the other exposure conditions should be changed (when a result of step S40 is YES), the controller 7 changes the exposure time and the exposure frequency (steps S41 and S42). If no other exposure condition should be changed (when a result of step S40 is NO), the toner patch process (step S4) is complete.

As described above, for forming the toner patch 52 during processing of the print job, the two toner patches 52 with the same toner concentrations are formed every time. However, this is given not for limitation. When the first toner patch 52 is to be formed after start of processing the print job, the two toner patches 52 with the same toner concentrations may be formed and the only single toner patch 52 which is adjusted to have the appropriate toner amount (toner concentration) may be formed when the toner patch 52 is formed on and after next time.

Figure 11:
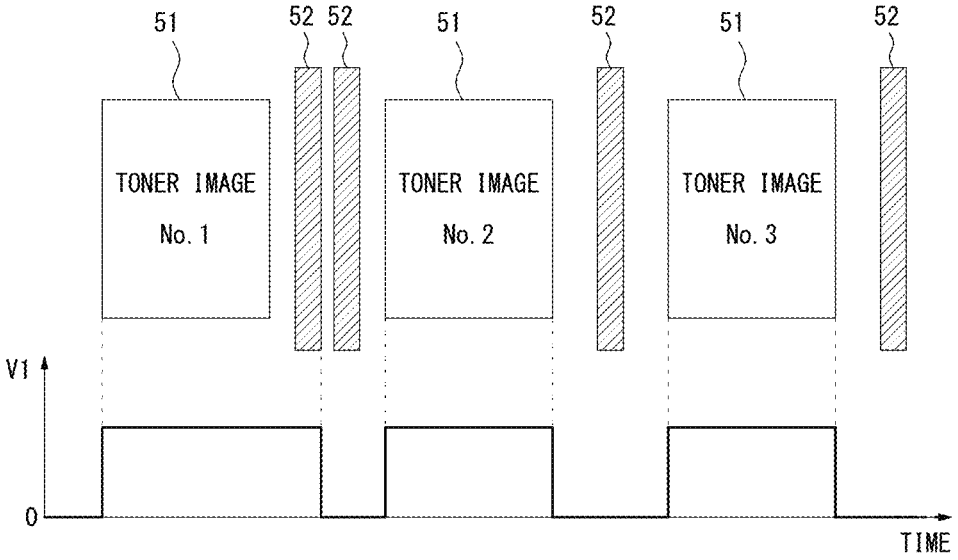
FIG. 11 illustrates another example of forming the toner patch.

FIG. 11 illustrates an example where the two toner patches 52 and 52 with the same toner concentrations are formed at first and only the single toner patch 52 with the adjusted toner concentration is formed on and after the second time. As illustrated in FIG. 11, once the job controller 40 starts processing the print job, the toner image 51 corresponding to the image data included in the print job is formed one after the other on the surface of the photoreceptor 30. When forming the first toner patch 52 between the two adjacent toner images 51 and 51 after starting processing of the print job, the patch forming unit 41 forms the two toner patches 52 and 52 with the same toner concentrations.

When the two toner patches 52 and 52 pass through the primary transfer position, the patch forming unit 41 transfers one of the toner patches 52 to the intermediate transfer belt 24 as well as the toner image 51, and controls the transfer of another toner patch 52. As a result, one of the toner patches 52 is transferred to the intermediate transfer belt 24 at the primary transfer rate close to 100%, and another toner patch 52 is controlled not to be transferred to the intermediate transfer belt 24. The patch adjuster 42 then obtains the concentration values D1 and D2 of the toner patch 52 transferred to the intermediate transfer belt 24, and adjusts the toner concentration for forming the toner patch 52 on and after the second time to be in a range of the predetermined lower limit to upper limit. Hence, when forming the toner patch 52 on and after the second time during processing of the print job as illustrated in FIG. 11, the patch forming unit 41 is enabled to form only the single toner patch 52 adjusted to have an appropriate toner concentration.

Everything else except for the points described above in the second preferred embodiment is the same as that in the first preferred embodiment.

Third Preferred Embodiment

The third preferred embodiment of the present invention is explained next. According to the second preferred embodiment, as described above, the example where the two toner patches 52 and 52 with the same toner concentrations are formed and the toner concentration transferred to the intermediate transfer belt 24 is measured is explained. According to the third preferred embodiment, when forming the first toner patch 52 after start of processing of the print job, two types of the toner patches having the different toner concentrations from each other are formed.

Figure 12:
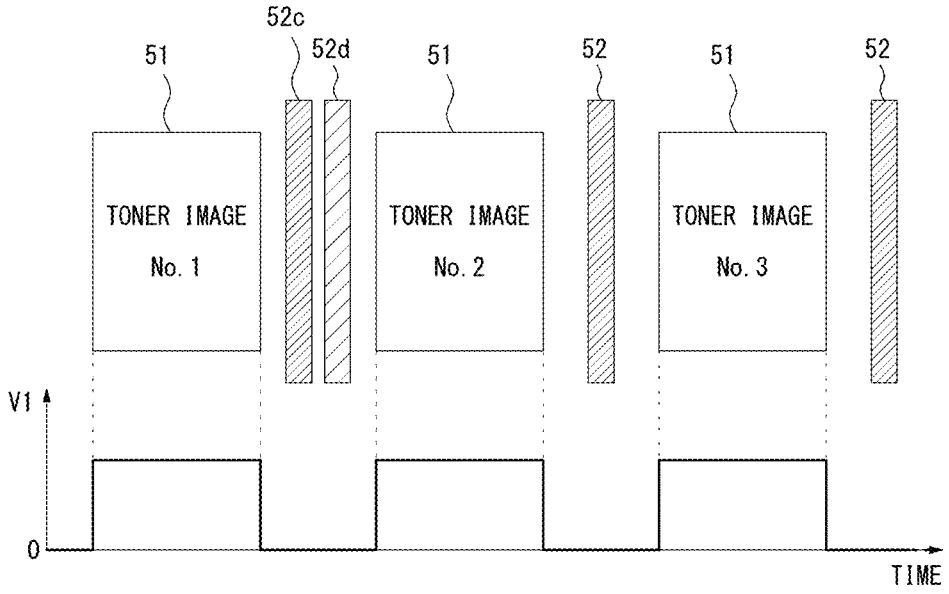
FIG. 12 illustrates another example of forming the toner patch.

FIG. 12 illustrates an example where two types of toner patches 52*c* and 52*d* with the different toner concentrations are formed and only the single toner patch 52 with the adjusted toner concentration is formed after the second time. As illustrated in FIG. 12, once the job controller 40 starts processing the print job, the toner image 51 corresponding to the image data included in the print job is formed one after the other on the surface of the photoreceptor 30. When forming the first toner patch 52 between the two adjacent toner images 51 and 51 after start of processing of the print job, the patch forming unit 41 changes the exposure amount by the exposure unit 20, for instance, so that it may form the two types of toner patches 52*c* and 52*d* with the different toner concentrations from each other on the photoreceptor 30.

When the two types of toner patches 52*c* and 52*d* pass through the primary transfer position, the patch forming unit 41 controls the transfer of the toner patches 52 to the intermediate transfer belt 24. To be more specific, the two types of toner patches 52*c* and 52*d* pass through the primary transfer position under the same condition in which the primary transfer to the intermediate transfer belt 24 is controlled. As a result, the two types of toner patches 52*c* and 52*d* are transferred to the intermediate transfer belt 24 at the same primary transfer rate.

The patch adjuster 42 obtains the concentration values of the two types of toner patches 52*c* and 52*d* transferred to the intermediate transfer belt 24. The two concentration values obtained by the patch adjuster 42 show the concentration values on the line L1 of FIG. 5. The patch adjuster 42 calculates a line passes through the two concentration values, and is enabled to correctly obtain a characteristic line corresponding to the line L1 of FIG. 5. After obtaining the correct line L1, the patch adjuster 42 adjusts the toner concentration for forming the toner patch 52 after the second time to be in a range of the predetermined lower limit to upper limit. Thus, the patch forming unit 41 is enabled to form only the single toner patch 52 which is adjusted to have the appropriate toner concentration when the toner patch 52 is formed on and after the second time during processing of the print job as illustrated in FIG. 12.

The main procedure performed by the controller 7 to form the above-described toner patch 52 is the same as that illustrated in the flow diagram of FIG. 6 of the first preferred embodiment. The toner patch process (step S4) of the third preferred embodiment is different from that of the first preferred embodiment and the second preferred embodiment. The toner patch process (step S4) of the third preferred embodiment is explained below.

Figure 13:
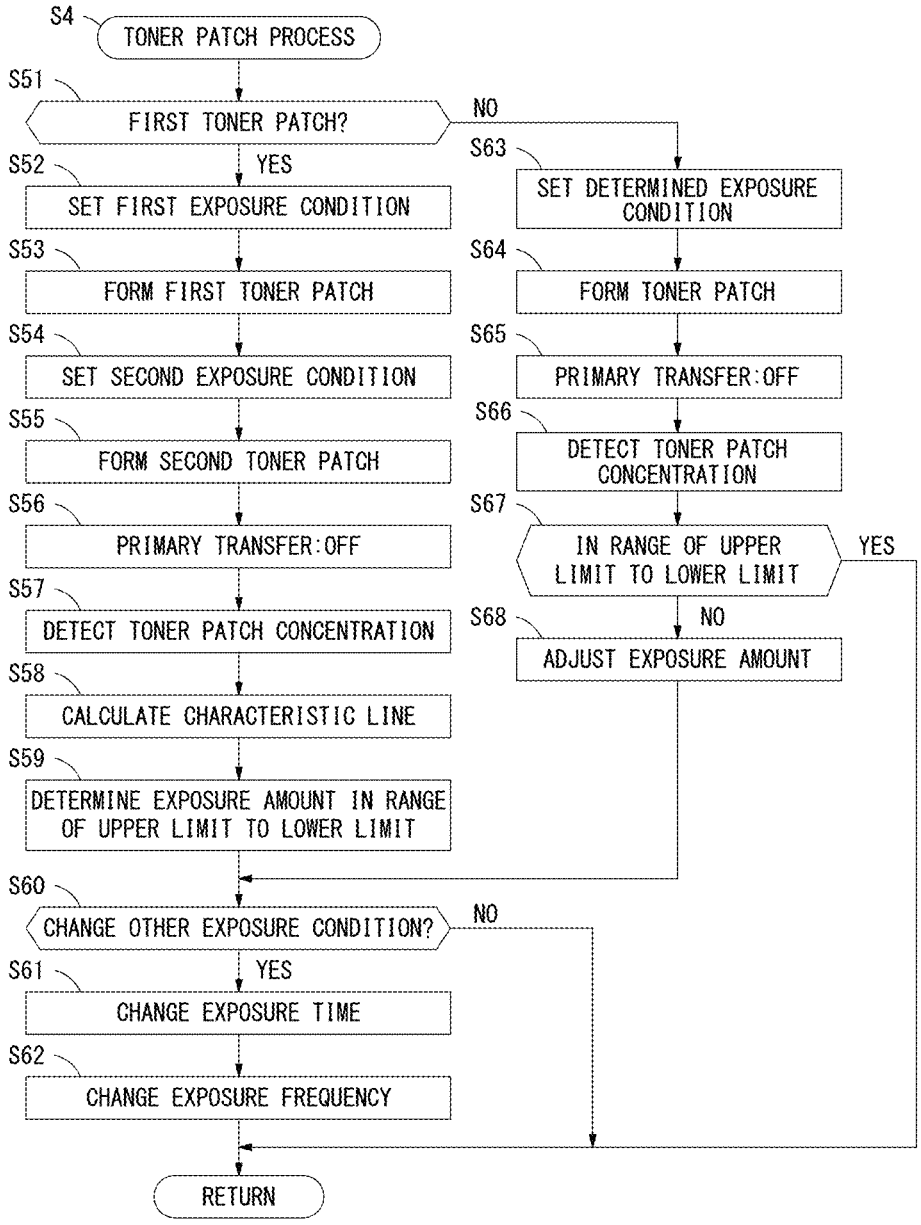
FIG. 13 illustrates a flow diagram explaining even another exemplary procedure of the toner patch process in detail.

FIG. 13 illustrates a flow diagram explaining an exemplary procedure of the toner patch process (step S4) in which the third preferred embodiment may be practiced in detail. After starting the toner patch process (step S4), the controller 7 determines if it is the first toner patch 52 formed after start of processing of the print job (step S51). If it is the first toner patch 52 (when a result of step S51 is YES), the controller 7 sets a first exposure condition for forming the first toner patch 52*c* (step S52), and forms the first toner patch 52*c* on the photoreceptor 30 based on the first exposure condition (step S53). The controller 7 then sets a second exposure condition for forming the second toner patch 52*d* (step S54), and forms the second toner patch 52*d* on the photoreceptor 30 based on the second exposure condition (step S55). As a result, the two types of toner patches 52*c* and 52*d* with the different toner concentrations are formed on the photoreceptor 30.

When the two types of toner patches 52*c* and 52*d* pass through the primary transfer position, the controller 7 turns off the primary transfer voltage V1 of the primary transfer roller 22 (step S56). As a result, the transfer of the two types of toner patches 52*a* and 52*b* with the different toner concentrations to the intermediate transfer belt 24 is controlled and the two types of toner patches 52*c* and 52*d* are transferred to the intermediate transfer belt 24 under the control.

The controller 7 obtains the concentration values of the two types of toner patches 52*c* and 52*d* detected by the toner concentration detecting sensor 28 (step S57), and calculates the characteristic line corresponding to the line L1 of FIG. 5 (step S58). The controller 7 determines the exposure amount that enables the toner amount of the toner patch 52 to be in a range of the predetermined lower limit to upper limit based on the characteristic line (step S59). The toner patch 52 formed on and after the second time is enabled to be adjusted to have the toner amount in a range of the predetermined lower limit to upper limit.

The controller 7 determines if it is necessary to change the other exposure conditions (step S60). If the other exposure conditions should be changed (when a result of step S60 is YES), the controller 7 changes the exposure time and the exposure frequency (steps S61 and S62). If no other exposure condition should be changed (when a result of step S60 is NO), the toner patch process (step S4) is complete.

If it is not the first toner patch 52 formed after start of processing of the print job (when a result of step S51 is NO), the controller 7 sets the exposure condition already determined (step S63), and forms the toner patch 52 on the photoreceptor 30 based on the exposure condition (step S64). The controller 7 turns off the primary transfer voltage V1 of the primary transfer roller 22 when the toner patch 52 passes through the primary transfer position (step S65). The controller 7 then obtains the concentration value D1 of the toner patch 52 detected by the toner concentration detecting sensor 28 (step S66), and determines if the toner amount of the toner patch 52 is in a range of the predetermined lower limit to upper limit (step S67). If the toner amount is in a range of the predetermined lower limit to upper limit, it means the appropriate toner amount is supplied to the cleaner 34 and the apparent stains with toner on the back of the recording material 9 do not appear. Thus, the additional adjustment of the exposure amount is not necessary. When the toner amount of the toner patch 52 is in a range of the predetermined upper limit to lower limit (when a result of step S67 is YES), the toner patch process (step S4) is complete.

When the toner amount of the toner patch 52 is not in a range of the predetermined upper limit to lower limit (when a result of step S67 is NO), the controller 7 readjusts the exposure amount (step S68). The process explained in the first preferred embodiment may be used for this readjustment, for example. When the exposure amount is readjusted, the process by the controller 7 moves on to the process in step S60. The other exposure conditions including the exposure time and the exposure frequency are readjusted as required.

Figure 14A:
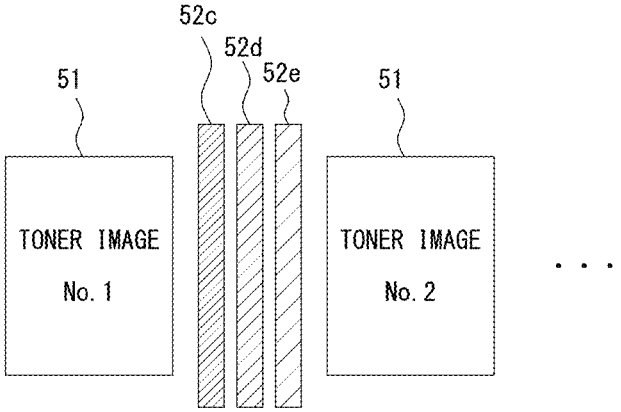
FIG. 14A and FIG. 14B illustrate an example where three types of the toner patches are formed.
Figure 14B:
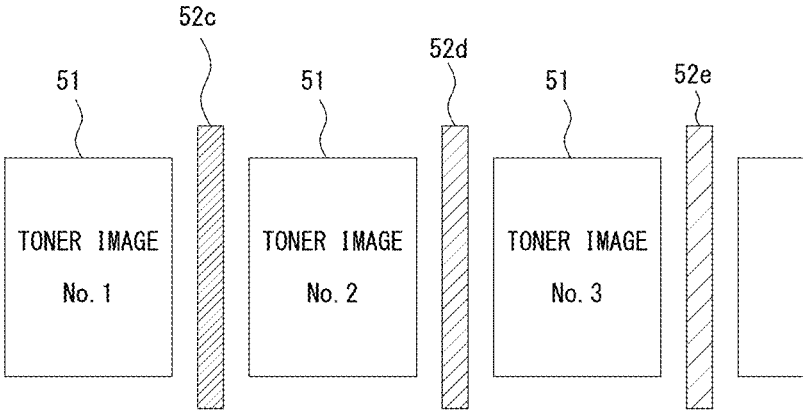

According to the third preferred embodiment, the two types of toner patches 52*c* and 52*d* with the different toner concentrations are formed when the first toner patch 52 is formed after start of processing of the print job. The number of the types of the toner patches 52 is not limited to two. More than three types of the toner patches 52 may be formed. FIG. 14A and FIG. 14B illustrate an example where three types of the toner patches 52*c*, 52*d* and 52*e* are formed. FIG. 14A illustrates an example where the three types of toner patches 52*c*, 52*d* and 52*e* are formed between the first toner image 51 and the second toner image 51. If more than the three types of toner patches 52*c*, 52*d* and 52*e* are formed and the characteristic line corresponding to the line L1 of FIG. 5 is calculated, reliability of the characteristic line is improved.

When it is difficult to form more than the three types of toner patches 52*c*, 52*d* and 52*e* between the two toner images 51 and 51, each of the three types of toner patches 52*c*, 52*d* and 52*e* may be formed one by one as illustrated in FIG. 14B. The third toner patch 52*e* is formed between the third toner image 51 and the fourth toner image 51. The process of calculating the characteristic line corresponding to the line L1 of FIG. 5 is, therefore, performed after the third toner image 51 is formed.

Everything else except for the points described above in the third preferred embodiment is the same as that in the first or the second referred embodiment.

Fourth Preferred Embodiment

The fourth preferred embodiment of the present invention is explained next. According to the fourth preferred embodiment, an example where the toner amount in main scanning direction X of the toner patch 52 is adjusted in accordance with a printing rate in main scanning direction X of the toner image 51 that is formed on the photoreceptor 30 prior to forming the toner patch 52 when the toner patch 52 is formed is explained.

Figure 15A:
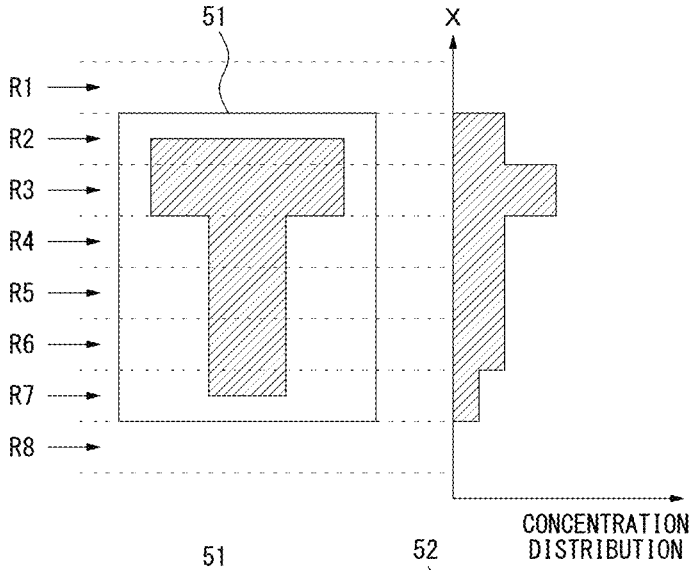
FIG. 15A, FIG. 15B and FIG. 15C illustrate another example of forming the toner patch.
Figure 15B:
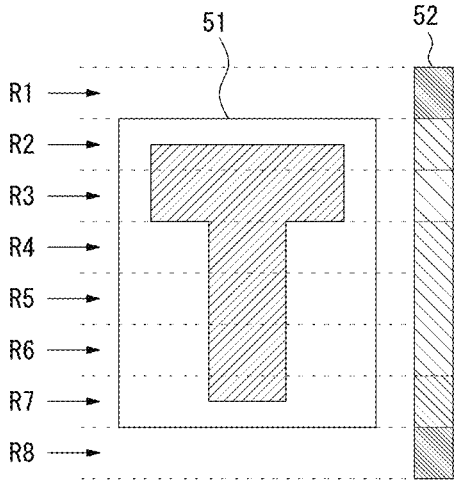
Figure 15C:
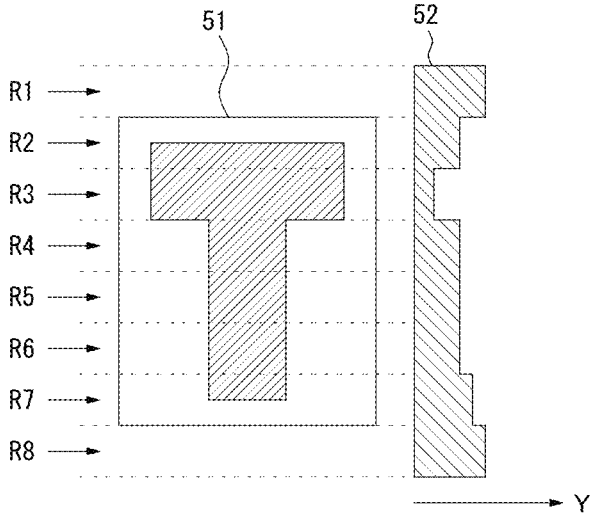

FIG. 15A, FIG. 15B and FIG. 15C illustrate an example of the toner patch 52 formed in the fourth preferred embodiment. According to the fourth preferred embodiment, when forming the toner patch 52, the patch forming unit 41 calculates the printing rate (concentration distribution) in main scanning direction X of the previous toner image 51 and analyzes the printing rate. As illustrated in FIG. 15A, for instance, the patch forming unit 41 divides a whole area in main scanning direction X which enables the toner patch 52 to be formed into multiple areas R1 to R8, and calculates the printing rate (concentration distribution) of the previous toner image 51 in each area R1 to R8. The patch forming unit 41 serves as a printing rate calculator.

For forming the toner patch 52, the patch forming unit 41 adjusts the toner amount used in the areas R1 to R8 in accordance with the printing rate of the previous toner image 51. The patch forming unit 41 sets the low toner concentration for the area having a high printing rate of the previous toner image 51 and the high toner concentration for the area having the low printing rate of the multiple areas R1 to R8, and forms the toner patch 52. In this case, the toner patch 52 formed on the photoreceptor 30 is a patch image having different toner concentrations in main scanning direction X. More specifically, the area with the high toner concentration has more toner amount and the area with the low toner concentration has less toner amount.

The toner concentration may not be adjusted in accordance with the printing rate. The exposure time may be adjusted in accordance with the printing rate, and the width (length) in the vertical scanning direction Y of the toner patch 52 may be changed as illustrated in FIG. 15C. To be more specific, the patch forming unit 41 sets the short exposure time for the area having the high printing rate of the previous toner image 51 and long exposure time for the area having the low printing rate of the multiple areas R1 to R8, and forms the toner patch 52 as illustrated in FIG. 15C. As a result, the toner patch 52 formed on the photoreceptor 30 includes the patch images having the different length in the vertical scanning direction Y for each area R1 to R8 arranged along main scanning direction X. More specifically, the area longer in the vertical scanning direction Y has more toner amount, and the area shorter in the vertical scanning direction Y has less toner amount.

As described above, main scanning direction X is divided into the multiple areas R1 to R8, and the toner amount used for each area is adjusted in accordance with the printing rate of the previous toner image 51 when the toner patch 52 is formed. The toner amount supplied to the cleaner 34 during processing of the print job may be uniform in main scanning direction X. As a result, uniform friction may be produced between the cleaner 34 and the photoreceptor 30 in main scanning direction X, and this enables to control occurrence of the local defect in the cleaner blade. According to the fourth preferred embodiment, the toner amount for forming the toner patch 52 can be held down to minimum, resulting in decrease in toner consumption.

According to the fourth preferred embodiment, the example where the printing rate in main scanning direction X of the previous single toner image 51 is analyzed and the toner amount in the main scanning direction X of the toner patch 52 is adjusted when the toner patch 52 is formed is explained. The toner image 51 to be analyzed by the patch forming unit 41, however, is not limited to be the previous single toner image 51. When the toner patch 52 is formed once every time a predetermined number of the toner images 51 is formed, for instance, the predetermined number of the toner images 51 before forming the toner patch 52 should preferably be analyzed.

The toner amount used for each of the multiple areas R1 to R8 is adjusted separately as described in the fourth preferred embodiment. In this case, the toner concentration detecting sensor 28 is provided with each area R1 to R8 individually, and the toner concentration of each area R1 to R8 is preferably detected by the corresponding toner concentration detecting sensor 28.

As described above, the patch forming unit 41 calculates the printing rate in main scanning direction X of the previous toner image 51 and adjusts the toner amount used for each area R1 to R8 based on the printing rate. However, this is given not for limitation. The same process may be performed by the patch adjuster 42. The way of adjusting the toner amount in main scanning direction X as explained in the fourth preferred embodiment may be applied to each of the first to the third preferred embodiments.

Although the embodiments of the present invention have been described and illustrated in detail, it is clearly understood that the same is by way of illustration and example only and not limitation, the scope of the present invention should be interpreted by terms of the appended claims.

Modifications

While the preferred embodiments of the present invention have been described above, the present invention is not limited to the preferred embodiments. Various modifications may be applied to the present invention.

In the above-described preferred embodiments, for example, the image forming device 1 is constructed by a printer. However, this is given not for limitation. The image forming device 1 may be constructed by a device such as one of MFPs (Multifunction Peripherals) including multiple functions, and a printer function may be included as one of the multiple functions.

In the above-described preferred embodiments, the image forming device 1 is constructed as a color device that forms color images. However, this is given not for limitation. The image forming device 1 may be a black and white specialized device that forms only black and white images.

What is claimed is:

1. An image forming device that forms a toner image on a surface of a photoreceptor, transfers the toner image to a recording material and outputs a printed recording material, comprises:
   - an intermediate transfer body that primarily transfers the toner image on the photoreceptor and secondarily transfers the toner image to the recording material;
   - a cleaner that removes a toner left on the surface of the photoreceptor;
   - a patch forming unit that forms a toner patch between two adjacent toner images when multiple toner images are continuously formed on the surface of the photoreceptor;
   - a concentration detector that detects concentration of the toner patch primarily transferred to the intermediate transfer body from the photoreceptor; and
   - a patch adjuster that adjusts toner amount used for forming the toner patch based on a result detected by the concentration detector.

2. The image forming device according to claim 1, further comprising:
   - a transfer controller that controls transfer of the toner patch formed on the surface of the photoreceptor to the intermediate transfer body, wherein
   - the concentration detector detects the concentration of the toner patch primarily transferred to the intermediate transfer body while the transfer to the intermediate transfer body is controlled by the transfer controller.

3. The image forming device according to claim 1, wherein
   - the patch adjuster adjusts a toner concentration for forming the toner patch based on the result detected by the concentration detector.

4. The image forming device according to claim 3, wherein
   - the patch adjuster adjusts the toner concentration for forming the toner patch to be in a range of a predetermined upper limit to lower limit.

5. The image forming device according to claim 3, wherein
   - the patch adjuster controls an exposure amount when the patch forming unit exposes the photoreceptor, and adjusts the toner concentration of the toner patch.

6. The image forming device according to claim 3, wherein
   - the patch adjuster controls an electrification voltage when the patch forming unit electrifies the photoreceptor, and adjusts the toner concentration of the toner patch.

7. The image forming device according to claim 3, wherein
   - the patch adjuster controls a developing bias when the patch forming unit provides toner with the surface of the photoreceptor and develops, and adjusts the toner concentration of the toner patch.

8. The image forming device according to claim 1, wherein
   - the patch adjuster adjusts a width in a vertical scanning direction of the toner patch based on the result detected by the concentration detector.

9. The image forming device according to claim 1, wherein the patch adjuster adjusts a frequency of forming the toner patch based on the result detected by the concentration detector.

10. The image forming device according to claim 1, wherein the patch adjuster adjusts the toner amount used for forming the toner patch in accordance with a size of the recording material.

11. The image forming device according to claim 1, wherein the patch adjuster adjusts the frequency of forming the toner patch in accordance with the size of the recording material.

12. The image forming device according to claim 1, further comprising:

a printing rate calculator that calculates a printing rate in a main scanning direction of the toner image formed on the surface of the photoreceptor, wherein the patch adjuster adjusts the toner amount in the main scanning direction used for forming the toner patch in accordance with the printing rate calculated by the printing rate calculator.

13. A toner patch forming method, that forms a toner patch between two adjacent toner images when multiple toner images are continuously formed on a surface of a photoreceptor, applied at an image forming device that forms the toner images on the surface of the photoreceptor, secondarily transfers to a recording material after primary transfer of the toner images to an intermediate transfer body and outputs a printed recording material, the method comprising:

forming the toner patch on the surface of the photoreceptor;

detecting a concentration of the toner patch primarily transferred to the intermediate transfer body from the photoreceptor; and adjusting a toner amount used for forming a next toner patch based on a detected result.

* * * * *